US008156678B2

(12) United States Patent
Hoel et al.

(10) Patent No.: US 8,156,678 B2
(45) Date of Patent: Apr. 17, 2012

(54) ADAPTIVE RAIL SYSTEM

(75) Inventors: Thomas Trail Hoel, Golden, CO (US); Trent Warncke, Lebanon, OH (US)

(73) Assignee: Thomas Trail Hoel, Golden, CO (US)

( * ) Notice: Subject to any disclaimer, the term of this patent is extended or adjusted under 35 U.S.C. 154(b) by 259 days.

(21) Appl. No.: 12/687,626

(22) Filed: Jan. 14, 2010

(65) Prior Publication Data

US 2010/0175295 A1 Jul. 15, 2010

Related U.S. Application Data

(60) Provisional application No. 61/205,044, filed on Jan. 14, 2009.

(51) Int. Cl.
*F41C 27/00* (2006.01)

(52) U.S. Cl. ..... 42/90; 42/85; 42/124

(58) Field of Classification Search ..... 42/85, 90, 42/124, 125, 127, 128
See application file for complete search history.

(56) References Cited

U.S. PATENT DOCUMENTS

| | | | | |
|---|---|---|---|---|
| 2,036,290 | A | | 4/1936 | McCann |
| 2,345,249 | A | | 3/1944 | Ferriroli |
| 2,436,948 | A | | 3/1948 | Williams |
| 2,510,289 | A | | 6/1950 | Livermore |
| 2,571,935 | A | * | 10/1951 | Pachmayr et al. ..... 42/128 |
| 4,878,307 | A | * | 11/1989 | Singletary ..... 42/124 |
| 5,430,967 | A | | 7/1995 | Woodman, III et al. |
| 5,595,011 | A | | 1/1997 | Gorslin |
| 5,806,228 | A | * | 9/1998 | Martel et al. ..... 42/124 |
| 6,438,888 | B1 | | 8/2002 | Lin et al. |
| 6,449,893 | B2 | | 9/2002 | Spinner |
| 6,637,144 | B2 | * | 10/2003 | Nelson et al. ..... 42/120 |
| 6,779,290 | B1 | * | 8/2004 | Houtsma ..... 42/148 |
| 6,931,778 | B1 | * | 8/2005 | Nelson et al. ..... 42/120 |
| 2005/0188602 | A1 | * | 9/2005 | Swan ..... 42/147 |
| 2007/0130817 | A1 | * | 6/2007 | Ballard ..... 42/118 |
| 2007/0271834 | A1 | * | 11/2007 | Keng ..... 42/124 |
| 2010/0275497 | A1 | * | 11/2010 | Brentzel ..... 42/125 |

* cited by examiner

*Primary Examiner* — Michael David
(74) *Attorney, Agent, or Firm* — James R. Eley; Michael A. Forhan; Eley Law Firm Co., LPA

(57) ABSTRACT

A detachable rail platform adaptable for selective and secure mounting to a weapon's rear iron sight assembly, the rear iron sight assembly having a sight base and a sight guard. The detachable rail platform includes a body having forward and rearward portions. The body further includes a rail portion and is positionable to envelop the rear iron sight assembly. A first clamp assembly is selectively engageable with the sight base at a predetermined position. A second clamp assembly is selectively engageable with the sight guard. Upon engagement of the first and second clamp assemblies to the sight base and the sight guard respectively, the rail platform is selectively and securely mounted to the weapon.

13 Claims, 4 Drawing Sheets

ADAPTIVE RAIL SYSTEM

This application claims priority to U.S. provisional patent application No. 61/205,044, filed Jan. 14, 2009, the contents of which are hereby incorporated by reference.

FIELD

This application relates broadly to the mounting of accessories to weapons. More particularly, it concerns a device that interfaces with the built-in iron sights of a weapon, and allows for the mounting of accessories, optics, or other useful items to a weapon through the use of standardized rail interfaces such as the MIL-STD M1913 Picatinny, NATO STANAG, and "Weaver" type rail interfaces attached to the device.

BACKGROUND

Most weapons have iron sight arrangements that are designed solely for use as primary sighting methods, but are not generally designed to also utilize these sights or their attachment points as secondary locating, attaching, or mounting locations or affixing points for additional accessories, or additional types of sighting apparatus.

Most weapons that use iron sights have the iron sights secured to substantial locations on the weapon's major components. These substantial fixing locations are required in order to assure that the sights are securely mounted and to offer substantial protection from inadvertent movement, dislocations, or damage. In addition to the original intended function, it is now recognized that the iron sights offer an additional opportunity for the purposes of utilizing them as a foundation for the location and attachment of additional accessories, equipment, or other sighting apparatus. While not all iron sighting systems known offer these advantages, there are certain common designs that are that are particularly suited to being used in this manner.

In particular, there exist common iron sight designs that incorporate a sliding leaf, sometimes referred to as a "ladder," or elevating platforms or other similar constructions where they incorporate the salient feature of said leaf or platform being hinged, affixed, or arranged at one end of the sight base with a moveable interface using a point or axis of movement that is combined with an attachment point. The attachment point commonly comprises a pin or axle pivotably nested within a set of holes or slots, and as such offers both a fixed, predetermined positioning point and an attachment point for an accessory mounting device.

Additional exploitable features of such suitable iron sights may include features such as guards, protectors, or other external or internal shapes or projections intended to protect, align, or support the iron sighting components. These features can also be appreciated as being particularly useful or suitable for adapting an accessory device, such as a "rail," to mechanically interface with these iron sight features in ways and manners never intended by the original design of the iron sights themselves. The arrangement of these physical features of the iron sighting system enables usages beyond their original intended purposes. What is needed is a means to exploit these features of the iron sight for selectively attaching an accessory device to the host weapon without requiring modification of the underlying weapon in any manner.

SUMMARY

The Rail Adaptive Platform System, hereinafter referred to as the "RAP System," or simply as "RAPS" as presented in the present disclosure, utilizes the features of an existing iron sight affixed to a weapon to act as a host for the attachment of additional weapon accessories, optics, lighting or other useful items to be mounted upon the host weapon without modification to any portion the host weapon. The applicant has observed that a number of existing iron sight designs found on a variety of weapons comprise features of a similar construction in at least two fundamental aspects. These two features are particularly suitable for the ready adaptation and employment of RAPS to existing weapons wherever they may be found.

Firstly, each of these iron sights or the rear iron sights have a sight base permanently affixed to the top portion of the weapon, such as a receiver cover, that allows for vertical displacement of the sighting leaf, ladder, platform, bar, or similar ranging component. Secondly, this common rear sight ranging component is designed to pivot, move, or translate vertically, if not also horizontally, by at least one end, and that at least one end of this component is affixed to the rear sight base by a pivot, hinge, or similar fastening means that, while retaining the ranging component in place in the sight base, also allows the component to move vertically to compensate for range. This particular characteristic design and construction of the rear iron sighting component is what enables the RAPS to adapt, locate, affix, and function over the host weapon's existing rear iron sights. This general type of sight base and ranging leaf arrangement is commonly found within the art and is the design configuration that the RAPS is designed to exploit.

While the following is not a comprehensive listing of suitable host weapons with suitable rear iron sights includes such weapons as the Mauser 98 rifle, the Moisin-Nagant MN30 rifle, the Degtyarev Light Machinegun, the Kalashnikov AK/AKM assault rifle and its derivatives and clones, and the Kalashnikov PK/PKM Light Machine Gun. Each of these weapons incorporate original rear iron sighting systems as standard equipment is particularly well-suited for use as the host weapon for the RAPS. While there are substantial numbers of suitable weapons, the applicant has successfully identified those basic common properties of such weapons that lend themselves to adaptation to the RAPS. Thus only a brief identification of the obvious examples need be made. Because the disclosure also describes a method for installing the RAPS in addition to its structural makeup, it shall be readily seen that with any such suitable arrangement of an iron sighting system in place on any chosen weapon, the RAPS may readily be adapted to use upon it. While the RAPS is designed to be adaptable to a wide variety of host weapons, for the purpose of clarity and brevity the following disclosure of the RAPS and its method of mounting is provided herein as it relates to a particularly suitable weapon design, that is, the Kalashnikov PKM Light Machine Gun, commonly referred to as the "PKM."

One object of the RAPS is to provide an attachment system and method that enables the attachment of a rail system to the rear iron sights of an existing weapon. The rail in turn provides for the attachment or mounting of weapon accessories such as optical sights, night vision devices, laser designators or targeting systems, and other weapon accessories through the use of a MIL-STD M1913 Picatinny rail interface as part of the uppermost surface of the RAPS. Another object of the disclosed RAPS is to achieve this interface without any modification or alteration to the existing weapon.

The objects of the instant disclosure are accomplished by the provision of a rail adaptive platform system that comprises a housing that is configured to fit over and substantially surround an existing rear iron sight of a weapon. A first engaging system is provided that secures the rear of the housing to a rear portion of existing rear iron sight base. A second engaging system is provided to secure the forward portion of the housing to a forward portion of the existing rear iron sight. A MIL-STD M1913 Picatinny rail interface is integral to and comprises the top surface of the housing.

BRIEF DESCRIPTION OF THE DRAWINGS

Further features of the inventive embodiments will become apparent to those skilled in the art to which the embodiments relate from reading the specification and claims with reference to the accompanying drawings, in which:

DETAILED DESCRIPTION

Figure 1:
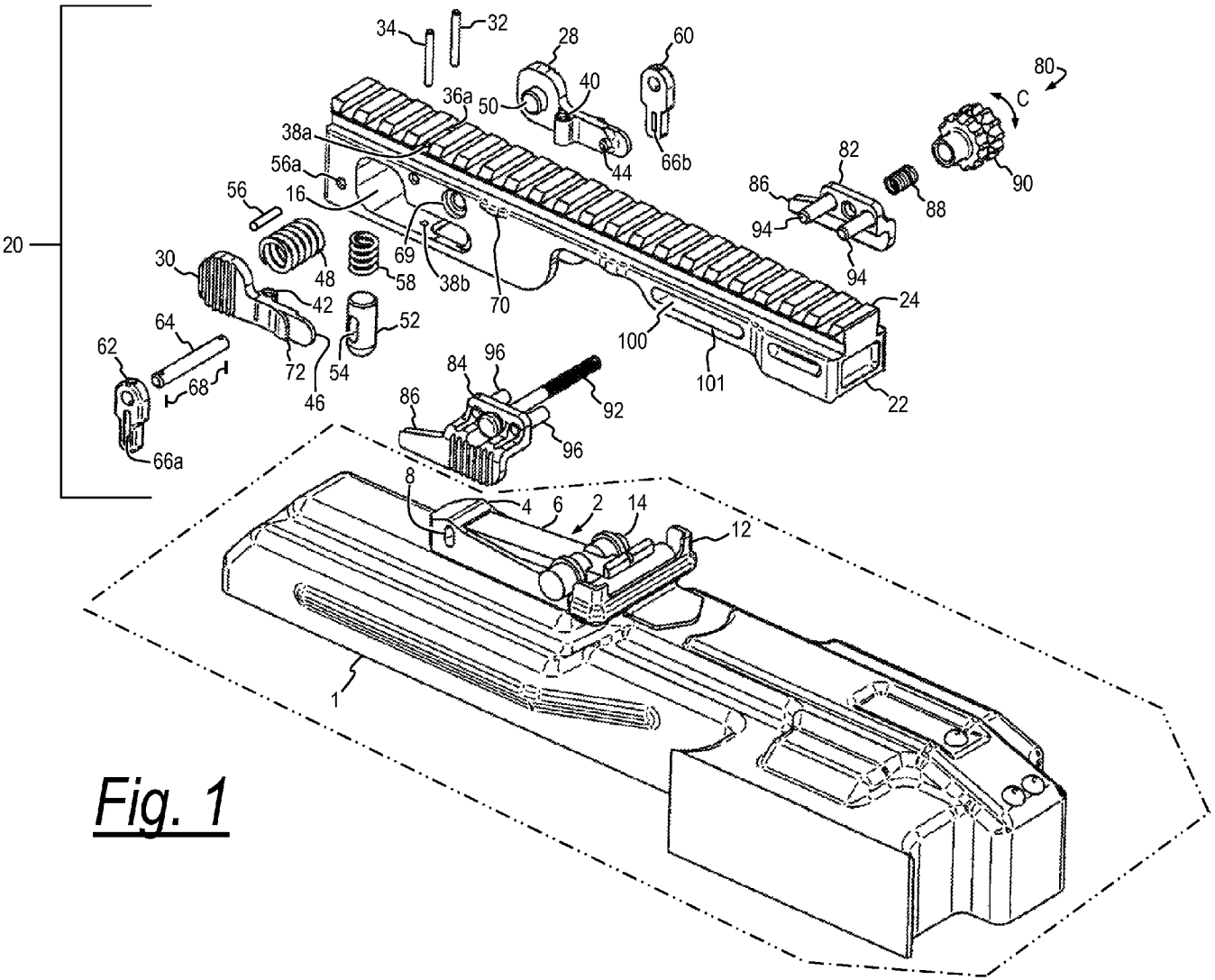
FIG. 1 is an exploded perspective view of an embodiment of a rail adaptive platform system according to the present disclosure.
Figure 2:
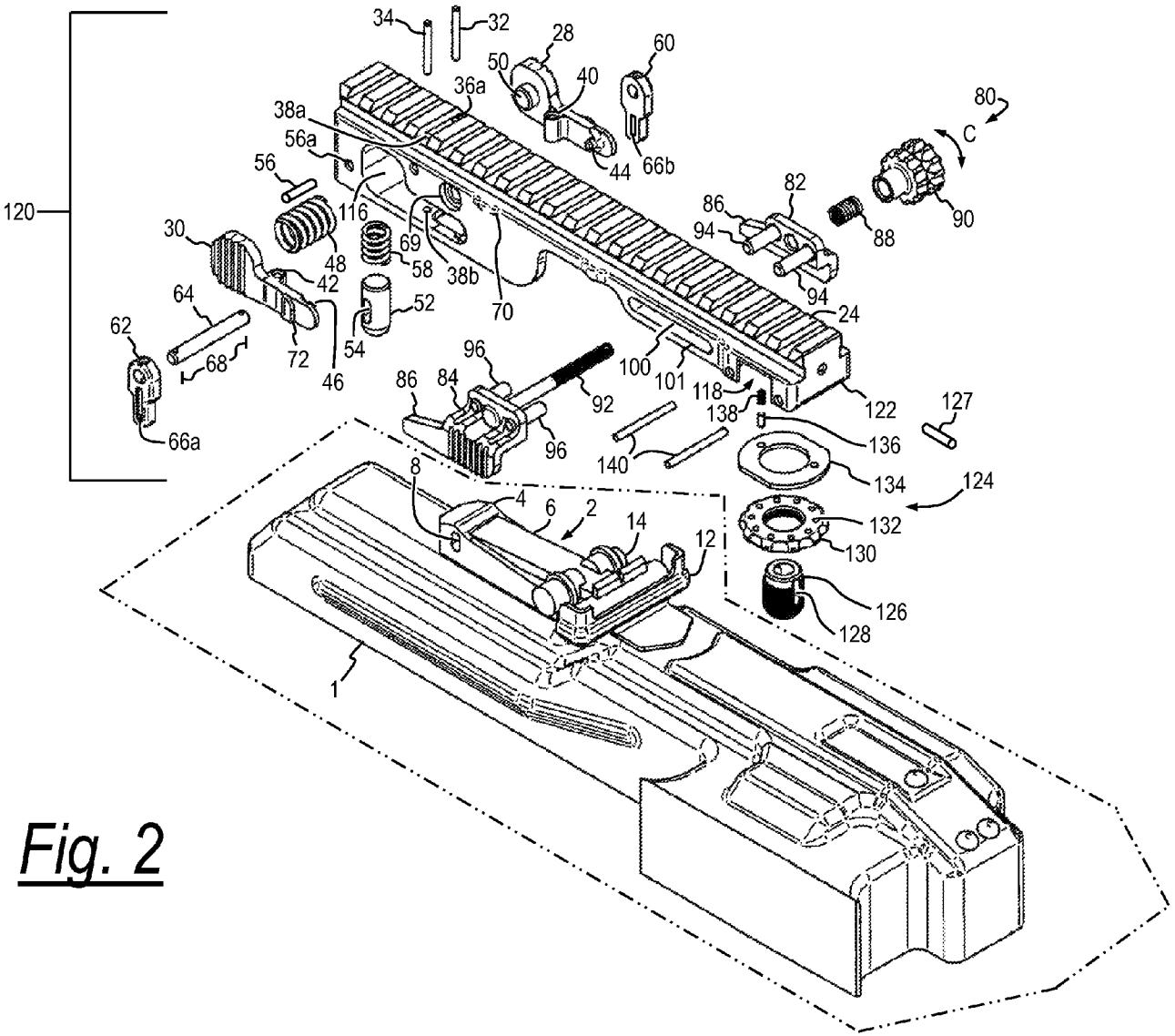
FIG. 2 is an exploded perspective view of another embodiment of a rail adaptive platform system according to the present disclosure.
Figure 3:
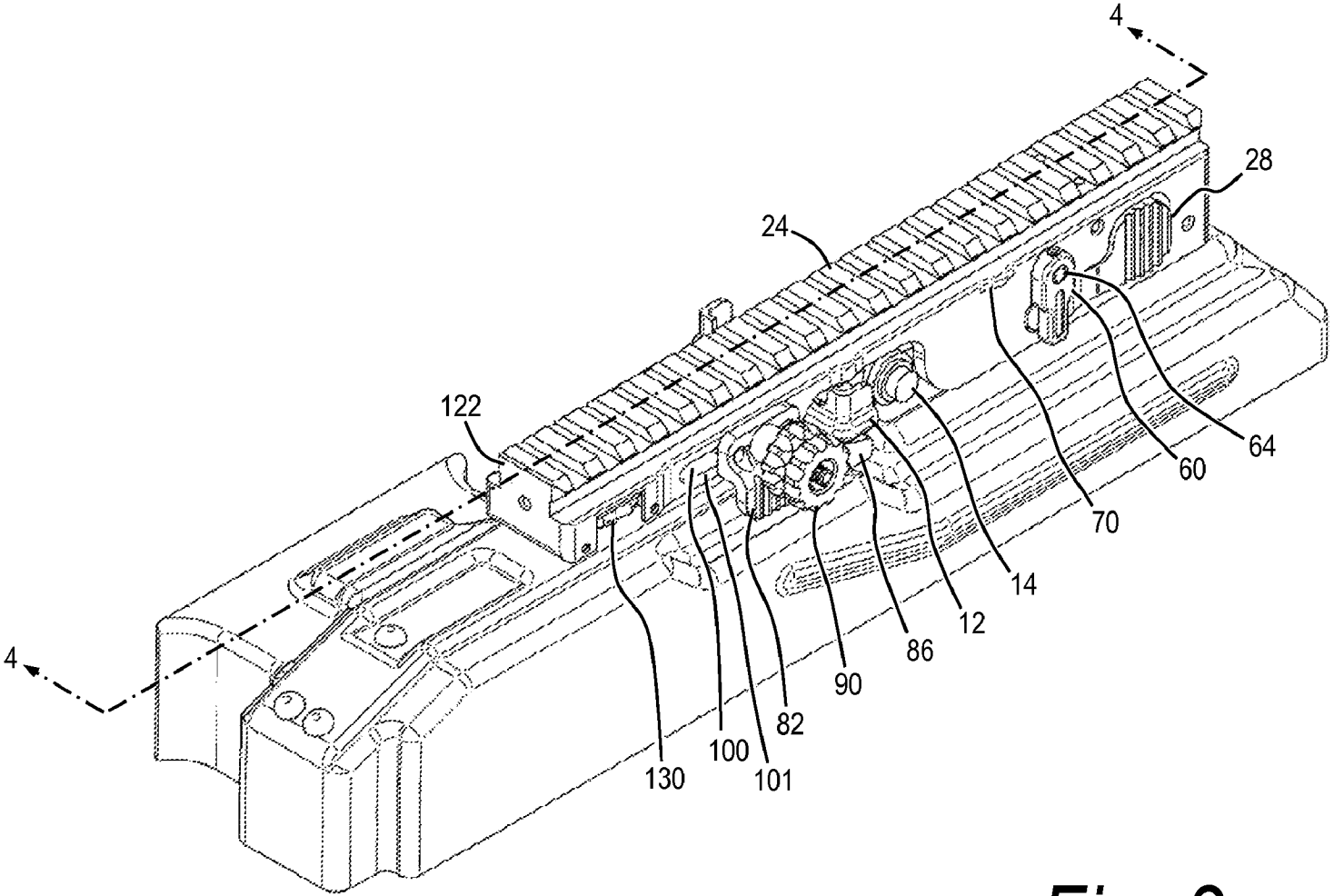
FIG. 3 is a perspective view of the rail adaptive platform system of FIG. 2 in engaged arrangement with a rear iron sight in accordance with an embodiment of the present disclosure and containing section line 4-4.

Referring first to FIG. 1, in the following disclosure the terms "front," "frontward" or "distal" refer to the rightmost portion of a RAPS 20 as viewed in the figure. The terms "rear," "rearward" or "proximal" refer to the leftmost portion of RAPS 20 as viewed in the figure. In this orientation, the front, or barrel portion (not shown) of a host weapon (not shown) is located on the right and the stock (not shown) of the weapon is located on the left. In use, an operator of the host weapon would be positioned at the rear, or at the left side of figure looking toward the right to sight the weapon. Also, in the discussion that follows, like reference numerals are employed to identify like elements and structures in the various figures.

As shown in FIG. 1 within the dashed enclosure, a receiver or top cover 1 having a rear iron sight assembly 2 permanently affixed to an upper surface, represents a common arrangement found on numerous pre-existing weapons with which the RAPS 20 is designed to interface. While this receiver cover 1 of a host weapon, (a Kalashnikov PK/PKM, not shown, has been selected for purposes of this disclosure) and the rear iron sight 2 are not part of the disclosed embodiment they are depicted in the figures as typical of the arrangements in which the RAPS 20 may be employed.

The Kalashnikov PK/PKM series of light machine guns uses a common iron sighting assembly 2, its basic design features, durability and proven construction being found on thousands of weapons around the world and is well-known within the art. The rear iron sight assembly 2 comprises a square-form sight base 4 shaped and constructed to contain a hollowed-out inner cavity wherein a sight ranging leaf or ladder 6 can be located and vertically adjusted by moving a slide assembly 14 along the ranging leaf as necessary for sighting at different ranges. This sight base 4 is affixed to the host weapon's top cover 1 with welds, rivets or other fastening means and is considered to be an integral part of the cover.

Located toward the rear and on both sides of sight base 4 are holes 8 used to locate, mount, and pivotally retain ranging leaf 6 by providing capturing pivot pins (not shown) located at the bottom and rear of the ranging leaf. The pivot pins engage holes 8 but only extend partially outwardly into the holes, thereby leaving small cavities or openings on each side of sight base 4, even with ranging leaf 6 in place. It is these remaining unused portions of holes 8 in the sight base 4 that provides for positive positioning and affixing of the rear portion of RAPS 20 to top cover 1. While shown as being oblong, holes 8 may be round as well and still provide the necessary engagement points for the rear portion of RAPS 20.

Looking now to the front of rear iron sight 2, a sight guard 12 can be seen. Sight guard 12 extends outwardly from sight base 4 to protect the elements of rear iron sight 2 from accidental damage or unintended movement of the slide assembly, which would adversely affect previously adjusted range settings. It is the extent to which sight guard 12 extends beyond each side of the top surface of top cover 1 that provides the necessary engagement points of the front portion of RAPS 20.

With continued reference to FIG. 1, details of the positive engagement of RAPS 20 with an existing rear iron sight 2 of a host weapon will now be presented. A RAPS body 22 is provided and is sized and shaped to fit over and substantially surround an existing rear iron sight 2. In so doing it can be seen that by careful design and construction of body 22, a tightly-fitted mating can be achieved with positive engagement to rear iron sight 2 at both its rear and front portions.

Engagement between the rear of rear iron sight 2 and the rear of RAPS 20 will be explained first. At the rear or proximal end of body 22, a clearance cut 16 is provided through the body to house and mount a set of left and right clamping levers 28, 30 respectively. Clamping levers 28, 30 are pivotally mounted within body 22 of the RAPS and secured in place by a set of pins 32, 34 passing through a set of left and right pivots 40, 42 respectively via a set of access holes 36*a*, 36*b* (not shown) and 38*a*, 38*b*. Pins 32, 34 may be roll pins or other suitable fasteners that are designed to be driven into place and remain in place until driven out. Clamping levers 28, 30 are additionally provided with standoffs as at 50, for positioning and retaining a lever biasing spring 48 between the two levers. Lever biasing spring 48 urges clamping levers 28, 30 to pivot outwardly from body 22 about points 40, 42. Clamping levers 28, 30 are each provided with a protruding stud 44, 46 respectively located on the interior surface and toward a front portion of each of the clamping levers. Studs 44 and 46 are shaped and sized to correspond and closely fit within holes 8 located at the rear end of sight base 4 and are urged inwardly toward body 22 by the outward force of clamping lever bias spring 48. It is the spring biased engagement of studs 44, 46 with holes 8 that provide one of the two positive engagement points of RAPS 20 with top-cover 1 through rear iron sight 2. Biasing spring 48 is designed to apply sufficient strong closure force to clamping levers 28, 30, driving studs 44 and 46 into the holes at 8 until intentionally released by inward pressure being applied to each of the levers. A finger pad pattern is provided at a rearward portion of each clamping lever 28, 30 which offers a tactile placement of an operator's finger to activate the levers inwardly (i.e., toward a longitudinal centerline of body 22) to release studs 44, 46 from their biased engagement with holes 8. Thus described, it can be seen that once body 22 of RAPS 20 is engaged with the rear portion of the PKM rear sight base 4, it will remain positively engaged until substantial pressure is applied to clamping levers 28, 30 to release the two.

Figure 4:
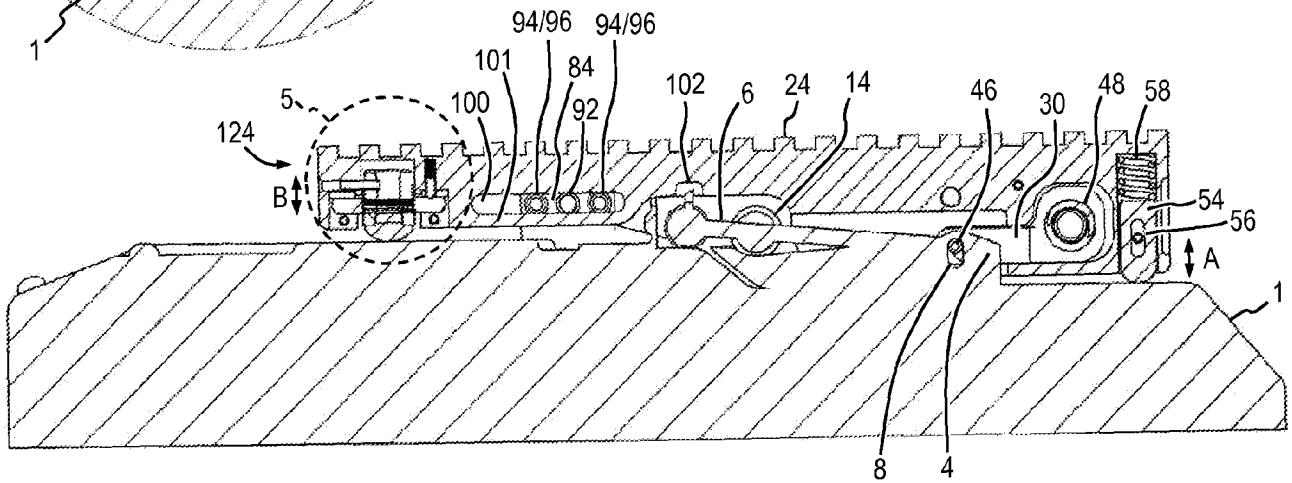
FIG. 4 is a cross-section elevation view of the mounted rail adaptive platform support of FIG. 3 taken along section line 4-4 according to an embodiment of the present disclosure.

While clamping levers 28, 30 provide the inward force to drive studs 44, 46 into holes 8, additional, upward force is needed to positively locate and forcefully urge the studs into the uppermost portion of the holes. To provide this upward force, a slotted biasing member 52 is located within a cavity located at the underside and rear of body 22. A spring 58 is provided to supply downward pressure against biasing member 52. Biasing member 52 is slidingly retained within body 22 by directing biasing a member pin 56 through a bias member retaining hole 56*a*, then through a biasing member slot 54. This arrangement provides a counter force (shown as "A" in FIG. 4) against the upper rear surface of top cover 1 when compressed. Biasing member 52 may be constructed from any suitable material that is durable enough for the intended purpose. However, it is preferable that it be fabricated from a material such as a hard polymer, to prevent marring of the upper surface of top cover 1. The combined inward pressure of the studs 44, 46 provided by clamping levers 28, 30 and the upward pressure forcing body 22 away from the top surface of top cover 1, combine for a secure engagement of the rear of RAPS to the host weapon via rear iron sight 2.

In addition, a manual type of impact safety arrangement may be provided to prevent clamping levers 28, 30 from inadvertent movement under load or from external impact and consequent, unintentional disengagement of studs 44, 46 from holes 8. In RAPS 20, as disclosed in FIG. 1, a set of left and right impact safety levers 60, 62 respectively are provided, one on each side at a rear portion of body 22. The impact safety levers 60, 62 are joined together via a through-hole 69 by a coupling member 64, each being held into engagement on opposing ends of the coupling member by a set of retaining pins 68. As disclosed, impact safety levers 60, 62 have a degree of rotation of about 90 degrees and rotate between an upper stop 70 on body 22 and a lower stop 72 located on an outside face of each of clamping levers 28, 30. However, it should be appreciated that more or less rotation may be provided without adversely impacting the functionality of the safety system.

When actuated, left and right safety levers 60, 62 are rotated downwardly until each confront corresponding lower stops as at 72. Once safety levers 60, 62 are in their lower, deployed position, they are held in place by the combination of friction, gravity and the outward pressure supplied by clamping levers 28, 30 when studs 44, 46 are engaged in holes 8. Under this condition, biased clamping levers 28, 30 are prevented from being depressed, thus securely preventing the clamping levers from releasing studs 44, 46 from their rear engagement with sight base 4. A frictional fit is preferably provided between coupling member 64 and through-hole 69 to prevent undesirable free swinging movement of impact safety levers 60, 62 which may be further provided with slots, as at 66*a* and 66*b*, to facilitate access to and removal of retaining pins 68, if necessary.

With continued reference to FIG. 1, a second and complementary rear iron sight 2 clamping arrangement is depicted at 80 near the forward portion of body 22. A set of left and right clamp members 82, 84 respectively mate to one another via a slide slot 100 and are coupled together by an engaging bolt 92, in combination with a knob 90 and a tension spring 88. In addition to being coupled together via engaging bolt 92, left and right clamp members 82, 84 are additionally joined by the coupling of a set of studs at 94 with their complements at 96 and are held in place using conventional means, such as with machine bolts (not shown). The bottoms of these coupled studs at 94, 96 bear and slide upon an upper surface of front slide assembly slot 100. Rotating knob 90 in the direction designated as "C" is effective to tighten or loosen the slidable clamping arrangement 80 within slide slot 100. Front clamp slot 100 is cut into body 22 at a slight incline running from the rear portion of the body to a forward portion of the body, forming a slightly inclined ramp at 101. Over-travel of knob 90 is prevented by a pin (not shown) passing through a shaft at an outside end of the engaging bolt 92 in a conventional manner.

Clamp members 82, 84 are each provided with a complementary included wing member 86 positioned to engage a front portion of rear iron site 2. This second clamping arrangement 80 is configured to exploit an available interface potential between the undersides of sight guard 12 that are provided on the PKM rear iron sight 2. This secondary interface takes advantage of the fact that sight guard 12 of the PKM rear iron sight 2 is constructed to be strong and inflexible, being intended to protect the ranging leaf 6 and slide assembly 14 (particularly that portion of the rear iron sight that provides windage adjustment) from damage and abuse.

Sight guard 12 is independent from rear iron sight 2 and is typically fabricated from stamped sheet metal into a roughly U-shaped piece. Sight guard 12 is typically welded onto the top surface of top cover 1 at a location directly in front of the rear iron sight 2. Thus designed and affixed, sight guard 12 forms a significantly robust part permanently affixed to the top cover 1.

The front clamp assembly 80 provides positive placement and secure engagement to sight guard 12 via inclined wings 86 bearing upon the left and right, overhanging undersides of the sight guard. This is accomplished by sliding the front clamping arrangement 80 so that the wings 86 of left and right claim members 82, 84 progressively engage sight guard 12. Once front clamping arrangement 80 has fully engaged the underside of sight guard 12, knob 90 is tightened. To prevent loss of engagement between front clamping arrangement 80 and sight guard 12, bottoms of studs 94, 96 come into binding contact with the top surface of inclined ramp 101, thereby restricting the travel of clamping arrangement 80 away from its engaged position.

The top surface of body 22 is constructed to have a section of MIL-STD M1913 Picatinny rail 24 as an integral component as its upper surface. As is widely known, MIL-STD rail 24 enables the deployment of various weapon accessories designed specifically to interface with it, such as optical sights, Night Vision Devices, laser designators or targeting systems which, without the rail 24 portion of the RAPS could not be readily implemented without modification to the host weapon.

Referring now to FIGS. 2-5, a second embodiment of the RAPS is depicted as 120. While most of the components as well as the clamping arrangements are essentially the same as with the RAPS 20 of FIG. 1, this embodiment incorporates a "minute-of-angle" ("MOA") adjustment assembly 124 located within a cavity 118 near the forward end of base 122. MOA is a term used regularly by shooters to describe accuracy. Defined loosely, one MOA equals one inch of displacement at a distance of 100 yards. So, if one were to shoot a rifle five times into a 100-yard target and every shot went into a one-inch circle, then the rifle could be said to shoot 1 MOA. Likewise, if every shot goes into a two-inch circle at 200 yards, then one would be shooting 1 MOA. A 10-inch group at 500 yards would be two MOA.

Figure 5:
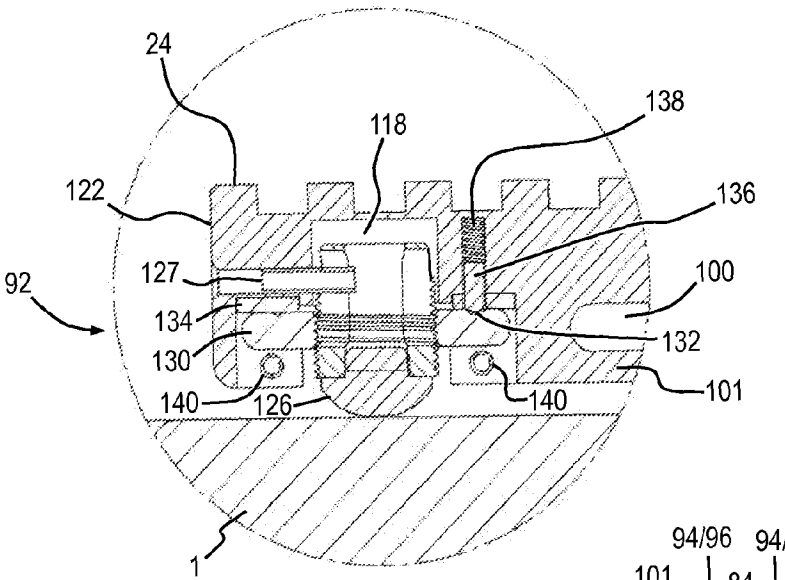
FIG. 5 is a detailed cross-section elevation view of a moment of angle (MOA) adjustment assembly bearing upon a portion of the iron sight host according to an embodiment of the rail adaptive platform system and according to the present disclosure.

Focusing primarily on FIG. 5, depicting a detail of the MOA adjustment assembly 124, it can be seen that the assembly enables RAPS 120 to be adjusted vertically to achieve approximately 90 MOA of additional ranging adjustments for devices mounted upon its rail 24. MOA adjustment assembly 124 is comprised of a threaded and slotted elevator 126 engaged with a threaded elevator ring, having a series of space-apart detents, as at 132. A coupled elevator ring 130 and elevator 126 are mounted within front cavity 118, located near the front of body 122. A spacer 134 is provided between the elevator 126 and the upper surface of cavity 118, through which a downwardly-biased pawl 136 contacts successive detents, as at 132 as the elevator ring is rotated. Pawl 136 is biased by a pawl spring 138. A set of retaining pins 140, when driven into body 122, hold MOA adjustment assembly 124 in place within cavity 118. A guide pin 127 engages an elevator slot 128 (FIG. 2) when driven into place and prevents elevator 126 from turning as elevator ring 130 is rotated. The components of the MOA adjustment assembly 124 cooperate to raise and lower the front, distal portion of the RAPS 120 in order to provide ranging adjustments for various accessories that may be mounted on the rail 24. Note, that front clamp assembly 80 may need to be loosened in order to permit the MOA adjustment assembly 124 to be adjusted up or down. Once adjusted, the front clamp assembly 80 may be snugged up to sight guard 12 and tightened.

In operation, RAPS 20 and 120 are mounted in much the same fashion, so only the description of the RAPS depicted in FIGS. 2-5 will be provided. To begin, activate by pinching and moving sight slide assembly 14 fully forward within sight base 4. This places ranging leaf 6 in its lowest position and closest to the top surface of top cover 1. Loosen front clamp assembly 80 and slide fully forward. Lower body 124 onto and surrounding rear iron sight assembly 2, being careful to ensure that a sight well 102 milled within the underside surface of body 122 is centered over a blade portion of the iron sight assembly. Next, vertically align studs 44, 46 with corresponding holes 8 and press downwardly, as shown by arrow "A" on FIG. 4, with sufficient pressure to overcome force provided by bias member 56 and bias spring 58. Once studs 44, 46 have entered corresponding holes 8 a distinct "snap" will indicate that they are properly engaged and that the first of two positioning and securing operations has been completed.

With the front clamp assembly 80 still fully forward, press down slightly on front portion of body 122 while sliding the front clamp assembly 122 rearwardly. As the front clamp assembly 122 is moved towards the rear, inclined clamp wings 86 progressively engage the left and right bottom edges of sight guard 12. Once front clamp assembly 80 is snugly in place against sight guard 12, tighten in place by turning knob 90 clockwise. After front clamp assembly 80 has been fully engaged, rotate left and right impact safety levers 60, 62 downwardly from their "home" positions, as at upper stops 70, to their lower "safety" positions at lower stops 72. Once impact safely levers 60, 62 have been rotated to lower stops 72, RAPS 120 is now fully installed on the host weapon via its top cover 1. Check the integrity of RAPS 120 mounting by applying separating force between RAPS and top cover 1. If not absolutely solid, double check and retighten both front and rear engagement points.

The components of the Rail Adaptive Platform System may be made from any type of material suitable for the expected use and environment including, without limitation, metal, plastic, fiberboard and composites. In addition, the components may be formed in any conventional manner including, but not limited to, casting, machining, forming, molding and stamping. Furthermore, the components of the system may be finished in any conventional manner, such as painting, coating, plating, molded-in colors and decorative features, or may be left unfinished.

While the Rail Adaptive Platform System has been shown and described with reference to a specific embodiment of the top cover 1 of a PKM machinegun, it should be understood that this is for descriptive and illustrative purposes only, and that RAPS may be used with other weapons with the appropriate modifications of the front and rear clamping mechanisms sized to fit a specific host weapon. Furthermore, in addition to or instead of a MIL-STD M1913 Picatinny interface the present invention may include, as non-limiting examples, industry-standard interfaces such as NATO STANAG scope mount interfaces, "Weaver" type rail interfaces, as well as connector or fastener interfaces.

While this invention has been shown and described with respect to a detailed embodiment thereof, it will be understood by those skilled in the art that changes in form and detail thereof may be made without departing from the scope of the claims of the invention.

What is claimed is:

1. A detachable rail platform configured for selective and secure mounting to a weapon's rear iron sight assembly, the rear iron sight assembly having a sight base and a sight guard, the detachable rail platform comprising: a body having forward and rearward portions, having a rail portion and being positionable to envelop the rear iron sight assembly; a first clamp assembly located towards one of the rearward portion and the forward portion of the body and being selectively engageable with the sight base at a predetermined position wherein the first clamp assembly also comprises a manually actuated pivoting lever mounted to each of two sides of the body and having a biasing element located between portions of the two levers wherein the rear of each lever is biased outwardly away from the body and a front portion of each lever is biased inwardly toward the body wherein a front portion of each lever engages a portion of the sight base; an upper surface configured as one of a connector interface, a fastener interface, a MIL-STD M 1913 Picatinny rail interface, a NATO STANAG rail interface, and a "Weaver" type rail interface; and a second clamp assembly being selectively engageable with the sight guard, wherein, upon engagement of the first and second clamp assemblies to the sight base and the sight guard respectively, the rail platform is selectively and securely mounted to the weapon.

2. The detachable rail platform of claim 1 wherein the second clamp assembly is located towards one of the rearward portion and the forward portion of the body.

3. The detachable rail platform of claim 2 wherein the second clamp assembly is slidable in a direction toward and away from the sight guard.

4. The detachable rail platform of claim 2 wherein the second clamp assembly is comprised of left and right clamp members connected to one another through a slot located within the body.

5. The detachable rail platform of claim 4 wherein the slot forms an upwardly inclined ramp from a rear portion of the slot to a front portion of the slot.

6. A detachable rail platform configured for selective and secure mounting to a weapon's rear iron sight assembly, the iron sight assembly having a sight base with a hole located toward the rear on each of two sides of the sight base and having a sight guard with side portions of the sight guard being wider than the rear iron sight, the detachable rail platform comprising: a body having forward and rearward portions, having a rail portion and being positionable to envelop the rear iron sight assembly; a first clamp assembly being selectively engageable with the sight base via the holes on either side of the sight base; and a second clamp assembly being selectively engageable with a bottom portion of the sight guard, wherein, upon engagement of the first and second clamp assemblies to the sight base and the sight guard respectively, the rail platform is selectively and securely mounted to the weapon.

7. The detachable rail platform of claim 6 additionally comprising an upper surface configured as one of a connector interface, a fastener interface, a MIL-STD M1913 Picatinny rail interface, a NATO STANAG rail interface, and a "Weaver" type rail interface.

8. The detachable rail platform of claim 6 wherein the first clamp assembly comprises a manually actuated pivoting lever having frontward and rearward portions and being mounted to each of two sides of the body and having a biasing element located between portions of the two levers.

9. The detachable rail platform of claim 8 wherein the rearward portion of each lever is biased outwardly away from the body and a front portion of each lever is biased inwardly toward the body.

10. The detachable rail platform of claim 9 wherein the inwardly biased front portion of each of the levers comprises a stud, the studs each being sized and positioned to engage the holes in the sight base when the body is placed in a predetermined position relative to the rear iron sight.

11. The detachable rail platform of claim 6 wherein the second clamp assembly slidably engages at least part of the bottom of the sight guard with at least one inclined wing portion and includes a knob for securing the clamp assembly in an engaged condition.

12. The detachable rail platform of claim 6 additionally comprising a biasing member located near the rearward portion of the body, the biasing member urging the rearward portion of the body away from the weapon.

13. The detachable rail platform of claim 6 additionally comprising a MOA adjustment assembly located near the forward portion of the body.

* * * * *